US006068581A

United States Patent [19]

Anderson

[11] Patent Number: 6,068,581

[45] Date of Patent: May 30, 2000

[54] METHOD AND APPARATUS FOR TESTING AND EXERCISING PELVIC MUSCLES

[75] Inventor: David William Anderson, Maple Grove, Minn.

[73] Assignee: Timm Medical Technologies, Inc., Eden Prairie, Minn.

[21] Appl. No.: 09/069,660

[22] Filed: Apr. 29, 1998

[51] Int. Cl.[7] ..... A63B 23/20; A63B 21/065

[52] U.S. Cl. ..... 482/93; 482/105; 482/148; 601/45; 600/29; 600/591; 73/379.01

[58] Field of Search ..... 482/82, 92, 93, 482/105, 106–109, 148, 908; 600/29, 30, 32, 591; 128/834; 601/45; 73/379.01; 473/290, 291, 335–339, 519

[56] References Cited

U.S. PATENT DOCUMENTS

| | | | |
|---|---|---|---|
| 1,138,196 | 5/1915 | Diehl | 482/106 |
| 1,291,465 | 1/1919 | Foreman . | |
| 2,521,336 | 9/1950 | Bramson . | |
| 2,763,265 | 9/1956 | Waters . | |
| 3,817,534 | 6/1974 | Carlino | 473/337 |
| 3,838,853 | 10/1974 | Fredenhagen . | |
| 4,050,449 | 9/1977 | Castellana et al. . | |
| 4,241,912 | 12/1980 | Mercer et al. . | |
| 4,253,660 | 3/1981 | Tiktin . | |
| 4,369,967 | 1/1983 | Kimura . | |
| 4,384,714 | 5/1983 | Kimura . | |
| 4,431,185 | 2/1984 | Cisneros . | |
| 4,574,791 | 3/1986 | Mitchener . | |
| 4,801,137 | 1/1989 | Douglass . | |
| 4,895,363 | 1/1990 | Plevnik et al. . | |
| 5,154,177 | 10/1992 | Eisman et al. | 600/591 |
| 5,213,557 | 5/1993 | Firth . | |
| 5,354,250 | 10/1994 | Christensen . | |
| 5,407,412 | 4/1995 | Plevnik et al. . | |
| 5,554,092 | 9/1996 | Harpstead et al. . | |

FOREIGN PATENT DOCUMENTS

| | | | |
|---|---|---|---|
| 0 088 173 A1 | 9/1983 | European Pat. Off. . | |
| 0 198 641 A2 | 10/1986 | European Pat. Off. . | |
| 0 392 854 A1 | 10/1990 | European Pat. Off. . | |
| 0 198 641 B1 | 11/1990 | European Pat. Off. . | |
| 538104 | 4/1993 | European Pat. Off. . | |
| 0 392 854 B1 | 9/1993 | European Pat. Off. . | |
| 1609 | 1/1909 | United Kingdom | 482/109 |
| 2 058 751 | 4/1981 | United Kingdom . | |
| 2 272 168 | 5/1994 | United Kingdom . | |
| 2 272 168 | 3/1995 | United Kingdom . | |

*Primary Examiner*—Richard J. Apley
*Assistant Examiner*—Victor Hwang
*Attorney, Agent, or Firm*—Merchant & Gould P.C.

[57] ABSTRACT

A pelvic floor muscle weight training kit includes a casing with a cap and a bottom, a set of weights, and a retaining member mounted on each of the weights. The cap has a first inside thread, and the bottom has a second inside thread. Each of the weights is different in shape and weight and is replaced in the casing individually. The retaining member has a third thread. The first and second threads of the casing are capable of being threaded with the third thread of the retaining member such that each of the weights is retained in a universal casing individually. The pelvic floor muscle weight training kit also provides for a method of testing and/or exercising pelvic floor muscles.

24 Claims, 2 Drawing Sheets

METHOD AND APPARATUS FOR TESTING AND EXERCISING PELVIC MUSCLES

FIELD OF THE INVENTION

The present invention relates to an apparatus and method for testing and/or strengthening user's pelvic floor muscles or other similar muscles in a body. In particular, the present invention relates to an apparatus and method to improve the tone of the pelvic floor muscles or other similar muscles in a body and to alleviate urinary incontinence that occurs during stress such as coughing, straining or laughing.

BACKGROUND OF THE INVENTION

Pelvic floor muscles tend to weaken with age or other physical conditions, such as lack of use. This weakening can also occur after childbirth. Also, many other women have no conscious control of the pelvic floor muscles and find it difficult to exercise them properly to strengthen them.

Various pelvic floor muscle exercising devices have been developed in an effort to strengthen and give conscious control over these muscles. A weighted, anatomically configured device is inserted into the vagina which tends to slip out. This slipping-out or losing the device feeling provides a biofeedback sensation which makes the pelvic floor muscles contract around the device, thus retaining it and accordingly exercising the pelvic floor muscles.

Currently, several pelvic floor muscle weight training devices are sold on the market. Also, several U.S. patents have described devices for testing and/or strengthening pelvic floor muscles. For example, Plevnik U.S. Pat. No. (4,895,363) disclosed a plurality of pelvic floor muscles exercise weights, each of which is of identical shape and size but of different weight. Each of the weights is made of two materials in varying proportion. A later patent by Plevnik U.S. Pat. No. (5,407,412) further disclosed a physiologically inert plastics outer surface covering each of the weights as described in the '363 patent. A patent by Firth U.S. Pat. No. (5,213,557) disclosed a device for exercising pelvic floor muscles having a set of two or more weights which fit together to form a shape complementary to at least a portion of an internal cavity of a casing.

However, these existing biofeedback devices are expensive to make. Further, many currently available devices have used lead or zinc in their construction. These materials would raise serious health concerns if they were to find their way from within the outer casing to the user's vaginal tissues.

The present invention offers a substantial improvement over existing pelvic floor muscles testing and/or exercising apparatus and methods.

SUMMARY OF THE INVENTION

The present invention relates to an apparatus and method for testing and/or strengthening user's pelvic floor muscles or other similar muscles in a body. In particular, the present invention relates to an apparatus and method to improve the tone of the pelvic floor muscles or other similar muscles in a body and to improve urinary incontinence occurring during stress.

The present invention is a pelvic floor weight training system. In one embodiment, a pelvic floor muscle weight training kit, comprising:

a casing including a cap and a bottom, the cap having a first inside thread, and the bottom having a second inside thread;

a set of weights, each of the weights being different in shape and weight and being replaced in the casing individually;

a retaining member being mounted on each of the weights, the retaining member having a third thread; and wherein the first and second threads of the casing are capable of being threaded with the third thread of the retaining member such that each of the weights is retained in the casing individually.

Further in one embodiment, the pelvic floor weight training system is supplied in the form of five graduated stainless steel weights which can be inserted into a cone shaped, re-usable plastic shell. When the cone shaped weight retained by the casing/shell is inserted into user's vagina, the user's pelvic floor muscles are consciously contracted to retain the weight/shell. As the user becomes able to retain a particular weight, the user may select the next heaviest weight in the series to further improve the muscle tone.

Further in one embodiment of the present invention, the weights are different in size, shape, and/or weight.

Still in one embodiment of the present invention, the weights are made of one material.

Additional in one embodiment of the present invention, the bottom and the top are separable from each other and connectable via the retaining piece.

Yet in one embodiment of the present invention, at least one of the weights has a cone shape. Further in one embodiment, at least one of the weights has a cylindrical shape.

Still in one embodiment of the present invention, the retaining piece is disposed proximate one end of each of the weights.

Further additional in one embodiment of the present invention, a retrieval loop is added for retrieving the casing out of user's vagina, the retrieval loop being knotted within the bottom of the casing. In one embodiment, the retrieval loop is made of nylon and epoxied in place within the bottom of the casing.

The present invention is also a method of testing the strength of the pelvic floor muscles. In one embodiment, the method providing a casing (or shell) and a set of different sized, weighted, and shaped weights includes the steps of:

a) placing a first of the weights from the set into the bottom of the casing;

b) threading the bottom onto the retaining piece proximate a first end of the first weight;

c) placing the cap of the casing over a second end of the first weight;

d) threading the cap onto the retaining piece to form a first weight/casing;

e) inserting the first weight/casing into user's vagina to check whether the pelvic floor muscles can support the first weight/casing;

if so, taking the first weight/casing out of the user's vagina, replacing the first weight by a second weight from the set to form a second weight/casing; and f) repeating the above steps until one of the weight/casings is just capable of being supported, the weight of that weight/casing providing an indication of the pelvic floor muscle strength.

The present invention is also a method of exercising the pelvic floor muscles. In one embodiment, the method providing a casing (or shell) and a set of different sized, weighted, and shaped weights includes the steps of:

a) placing a first of the weights from the set into the casing;

b) threading the bottom onto the retaining piece proximate a first end of the first weight;

c) placing the cap of the casing over a second end of the first weight;

d) threading the cap onto the retaining piece to form a first weight/casing; and e) inserting the first weight/casing into user's vagina to check whether the pelvic floor muscles can support the first weight/casing;

if so, taking the first weight/casing out of the user's vagina, replacing the first weight by a second weight from the set to form a second weight/casing, the second weight being heavier than the first weight; if not, replacing the first weight by a third weight from the set to form a third weight/casing, the third weight being lighter than the first weight; and retaining the weight/casing whose weight is just capable of being supported by exerting voluntary holding for a predetermined time.

Other embodiments of the pelvic floor muscle testing and/or exercising (or strengthening) system and method in accordance with the principles of the invention may include alternative or optional additional aspects. One such aspect of the present invention is that other appropriate threaded pieces can be used to retain weights within the universal casing. It will be appreciated that other equivalent alternative embodiments can be used without departure of the present invention.

However, the above mentioned embodiments and many alternative, equivalent embodiments in accordance with the present invention are appreciated by a person skilled in the art. These embodiments do not include a plurality of weights of identical shape and identical size but of different weights. Further, the weight of the pelvic floor weight training system in the present invention is not made of different materials. Furthermore, the pelvic floor weight training system of the present invention does not include more than one weight which would fit together to form a shape complementary to at least a portion of an internal cavity of the casing or shell.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE PREFERRED EMBODIMENT

The present invention relates to an apparatus and method for testing and/or exercising to strengthen user's pelvic floor muscles or other similar muscles in a body. In particular, the present invention relates to an apparatus and method to improve the tone of the pelvic floor muscles or other similar muscles in a body and to improve urinary incontinence due to stress.

Figure 1:
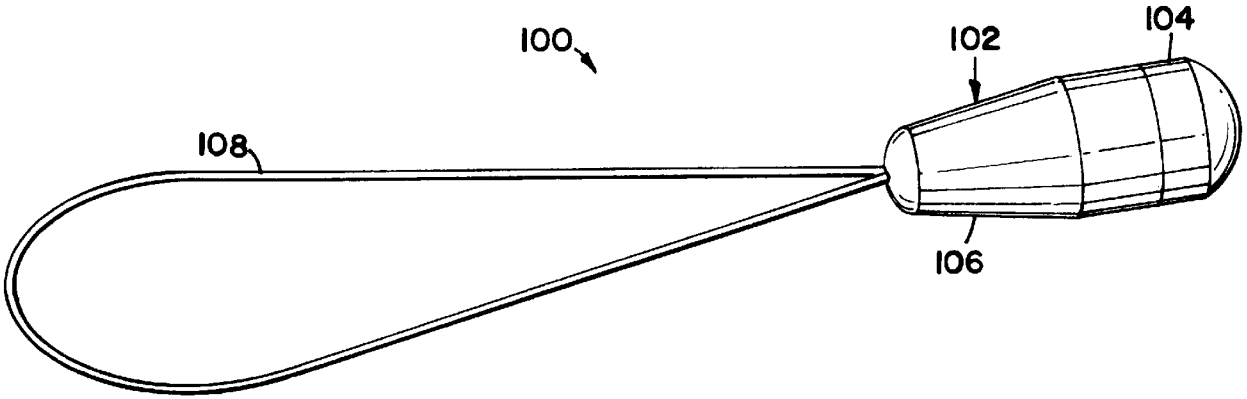
FIG. 1 is a perspective view of a pelvic floor weight testing and/or exercising system according to the present invention.

As shown in FIG. 1, a pelvic floor weight testing and/or exercising system 100 is shown. The system 100 includes a casing 102 with a cap 104 and a bottom 106, and a retrieval loop 108 attached to the bottom 106 of the casing 102. In one embodiment, the loop 108 is knotted at the inside of the bottom 106 and extends from the bottom 106. It is appreciated that other configuration and arrangement of the attachment between the loop 108 and the casing 102 can be used without departure from the present invention. For example, the loop 108 can be integrally connected to the bottom 106, either inside or outside of the bottom 106. In another example, the loop 108 can be attached to the cap 104 of the casing 102 by the same or other equivalent attachment method. In addition, the loop 108 can be epoxied in place within the casing, either bottom 106 or top 104, with EP21LV two part epoxy manufactured by, for example, Master Bond, Inc.

The system 100 is inserted into user's vagina, and the loop 108 extends from the vagina so that the user can retrieve the system 100 from the user's vagina. In one embodiment, the retrieval loop length extending from the bottom 106 is approximately 5 to 6 inches long. It is appreciated that other length can be used as desired by the user.

The casing 102, its bottom 106 and cap 104 are manufactured from injection molded, for example, Lustran ABS 348-2002 plastic manufactured by, for example, Bayer Corporation. The assembled casing 102 measures approximately 0.86 inches in major diameter and 2.1 inches in length. It is appreciated that other dimensions of the casing 102 can be used within the principles of the invention.

Figure 2:
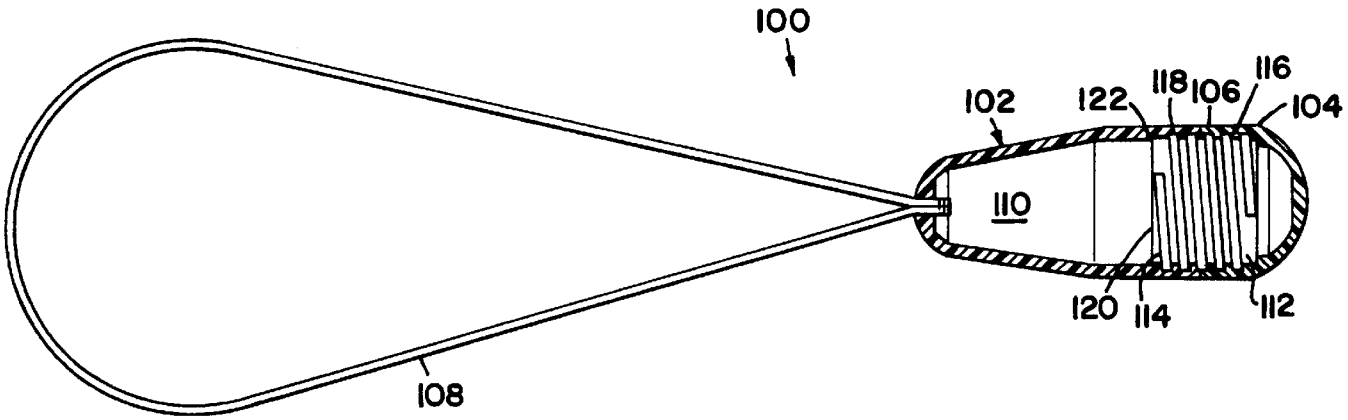
FIG. 2 is a longitudinal cross-sectional view of the pelvic floor weight testing and/or exercising system according to the present invention.

As shown in FIG. 2, a weight 110 is retained in the casing 102. The casing 102 has a cone shape, and the weight 110 can be a cone shape as well. The weight 110 may generally follow the contour of the inside of the casing 102.

Also shown in FIG. 2, a retaining piece 112 is mounted on the weight 110. The retainer 112 has a male thread 114 which is coupled to a female thread 116 of the cap 104 and a female thread 118 of the bottom 106. In assembly, the weight 110 with the retaining piece 112 is inserted into the bottom 106 of the casing 102 and is threaded onto the bottom 106 via the female thread 118 and a portion of the male thread 114. The other end of the weight 110 is covered by the cap 104 and is threaded onto the cap 104 via the female thread 116 and a portion of the male thread 114. It is appreciated that the assembly can be different in order. For example, the cap 104 can be threaded onto the weight first.

Further in assembly, the top 104 and the bottom 106 are screwed on the retaining piece 112 until the top 104 and the bottom 106 abut one another. The retaining piece 112 has a leading edge 120 that mates with a shoulder 122 within the bottom 106 so as to position and maintain the weight in proper place and/or orientation within the casing 102.

The retaining piece 112 with the male thread 114 is injection molded (as mentioned above, ABS) and is attached to the stainless steel weight 110 by the same epoxy mentioned above (EP21LV). It is appreciated that other types of molding techniques or attachment arrangements can be used to mount the retaining piece 112 onto the weight 110.

Figure 3:
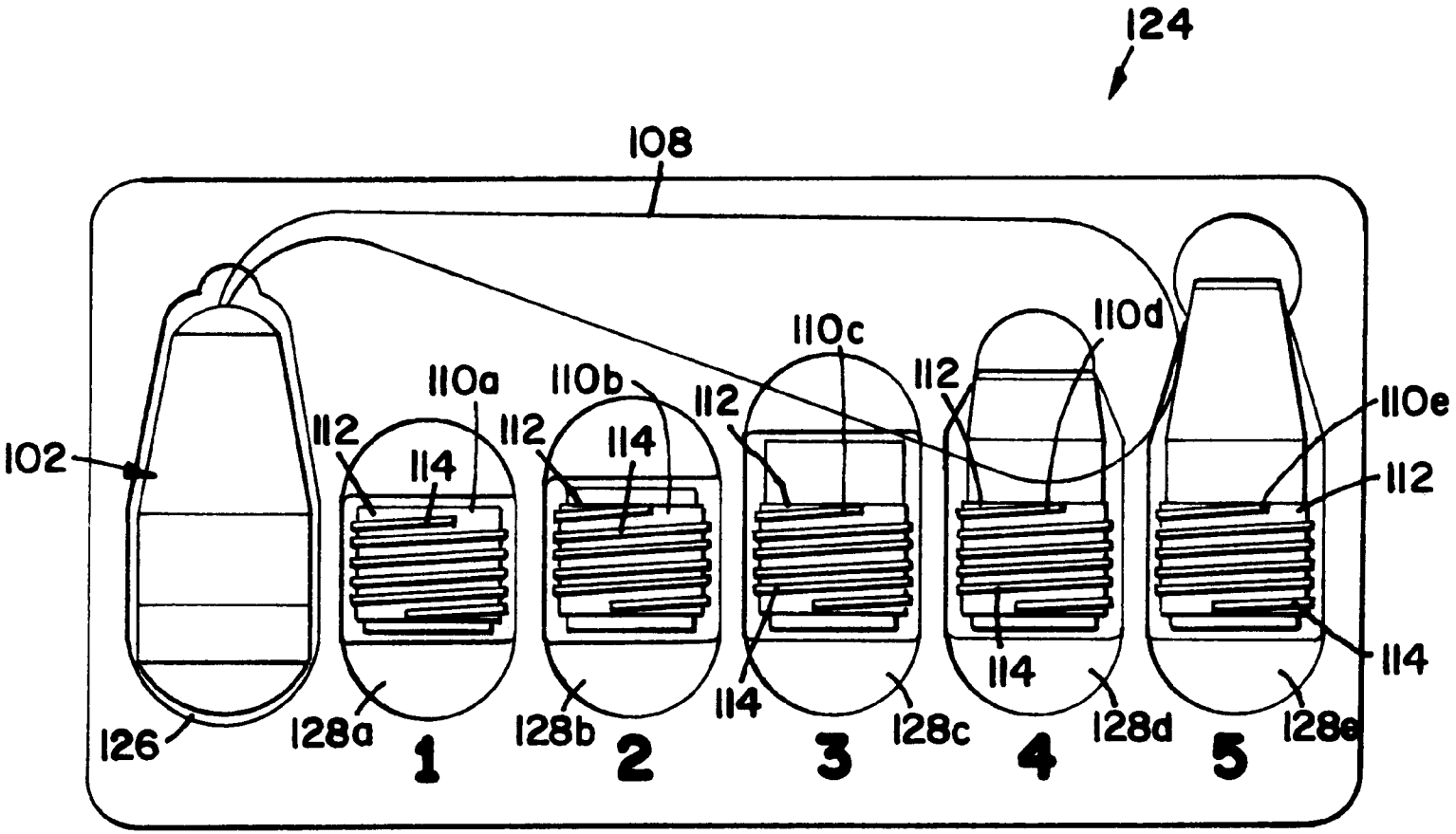
FIG. 3 is a plane view of the pelvic floor weight testing and/or exercising system with a set of weights resting in a kit according to the present invention.

As shown in FIG. 3, a pelvic floor muscle weight training kit 124 is shown. In the kit 124, the casing 102 is placed in a tray pocket 126. The kit 124 includes a set of five graduated weights 110*a*, 110*b*, 110*c*, 110*d*, 110*e*, the weight 110*a* being the lightest and the weight 110*e* being the heaviest, in the set. The weights are placed in tray pockets 128*a*, 128*b*, 128*c*, 128*d*, and 128*e*, respectively. The size of each weight, marked as being 1 to 5, are displayed in the kit outside of the respective tray pocket.

Also shown in FIG. 3, each of the weights are different in shape, size, and/or weight. The same retaining piece 112 with the male thread 114 is mounted on each of the weights. Accordingly, the casing 102 is a universal casing to retain each of the weights in the kit 124. In one embodiment, the combination of various weights provide the user with the following series of weights:

| Weight # | Weight |
|---|---|
| 1 | 20.0 g |
| 2 | 32.5 g |
| 3 | 45.0 g |
| 4 | 57.5 g |
| 5 | 70.0 g |

The above table shows a set of weights merely for illustration purposes, not for limitation. The shape of the weights can be any suitable shapes, such as a cone shape, a cylinder shape, a column shape, etc. Also, the size of the weights can be any suitable sizes as desired by the user. Further, the weight of the weights can be any suitable weights as desired by the user. In alternative embodiments, additional or less weights scan be included in a kit. Further, specially designed weights with different size, shape, or weight can be made as well. In one set of weights, "0" weight is defined to be the weight of the retaining piece 112 with the same ABS male thread as the standard weight (ABS weight). This combination of the retaining piece 112 ("0" weight or ABS weight) and the casing 102 provides the user with a 13.5 g weight. In use of other weights, the stainless steel weight #1 to weight #5 replaces the ABS weight with a similar geometry from weight #1 to weight #5. A "6" weight is a weight in which the male thread is formed in the stainless steel so that there may not need a retaining piece with an ABS male thread. The combination of "6" weight and the casing 102 provides the user with an 80.0 g weight. The above examples of weights are merely for illustration, not for limitation. It is appreciated that different weights can be arranged and configured within the principles of the invention.

The kit 124 may include a tray cover for storage or transportation. In one embodiment, the kit 124 can be in a vacu-formed clam shell tray. It is appreciated that other types of shipping or storage configuration and arrangement can be used without departure from the scope of the invention.

To test a user's pelvic floor muscles strength, the set of weights, such as the ones shown in FIG. 3, can be used. Each of the weights is individually retained in the universal casing 102. For example, the weight #2 is placed into the bottom 106 of the casing 102. Next, the bottom 106 is threaded onto a portion of the male thread 114 of the retaining piece 112 proximate the end of the weight #2. Then, the cap 104 is placed over the other end of the weight #2 and is threaded onto a portion of the male thread 114 of the retaining piece 112 to form a weight/casing insert. Then, the weight/casing insert is inserted into the user's vagina to check whether the pelvic floor muscles can support the weight/casing insert. If so, the weight/casing insert is taken out of the user's vagina by pulling the retrieval loop 108, and weight #2 is replaced by another heavier weight from the set to form another weight/casing insert. If not, a lighter weight may be used to replace weight #2. If weight #2 is just capable of being supported, the weight of that weight/casing insert indicates the user's pelvic floor muscle strength. In the former two situations, the above steps are repeated until one of the weight/casings is just capable of being supported, the weight of that weight/casing providing an indication of the pelvic floor muscle strength.

To exercise a user's pelvic floor muscles, the set of weights, such as the ones shown in FIG. 3, can be used. Each of the weights is individually retained in the universal casing 102. For example, the weight #2 is placed into the bottom 106 of the casing 102. Next, the bottom 106 is threaded onto a portion of the male thread 114 of the retaining piece 112 proximate the end of the weight #2. Then, the cap 104 is placed over the other end of the weight #2 and is threaded onto a portion of the male thread 114 of the retaining piece 112 to form a weight/casing insert. Then, the weight/casing insert is inserted into the user's vagina to check whether the pelvic floor muscles can support the weight/casing insert. If so, the weight/casing insert is taken out of the user's vagina by pulling the retrieval loop 108, and weight #2 is replaced by another heavier weight from the set to form another weight/casing insert. If not, a lighter weight may be used to replace weight #2. If weight #2 is just capable of being supported, the weight/casing is retained by the user by exerting voluntary holding for a predetermined time. In the former two situations, the above steps are repeated until one of the weight/casings is just capable of being supported. After a period of time of exercise, the user's muscles become stronger. The user can select the next heaviest weight in the set to further improve the muscles. A heavier weight can be used to replace the weight in the casing.

The pelvic floor muscle training system of the present invention is easy to assemble and use and is less expensive to make. Further, the system does not use lead or zinc materials in its construction. These materials would raise serious health concerns if they find their way from within the outer casing to the user's vaginal tissues.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A pelvic floor muscle weight training kit, comprising:

a casing including a cap and a bottom, the cap having a first inside thread, and the bottom having a second inside thread;

a set of weights, each of the weights being different in shape and weight and retainable individually in the casing; and a retaining member being mountable on each of the weights, the retaining member having a third thread;

wherein the retaining member and its respective weight are encased within the casing by engaging the first and second threads with the third thread.

2. A pelvic floor muscle weight training kit of claim 1, wherein each of the weights is made of one material.

3. A pelvic floor muscle weight training kit of claim 1, wherein the set of weights are five graduated stainless steel weights.

4. A pelvic floor muscle weight training kit of claim 1, wherein the bottom has a cone shape with a wider first end and a narrower second end.

5. A pelvic floor muscle weight training kit of claim 1, wherein the bottom and the cap are separable from each other and connectable via the retaining member.

6. A pelvic floor muscle weight training kit of claim 1, wherein at least one of the weights has a cone shape.

7. A pelvic floor muscle weight training kit of claim 1, wherein at least one of the weights has a cylindrical shape.

8. A pelvic floor muscle weight training kit of claim 1, wherein the retaining member is disposed proximate one end of each of the weights.

9. A pelvic floor muscle weight training kit of claim 1, further comprising a retrieval loop for retrieving the casing out of user's vagina, the retrieval loop being knotted within the bottom of the casing.

10. A pelvic floor muscle weight training kit of claim 9, wherein the retrieval loop is made of nylon and epoxied in place within the bottom of the casing.

11. A pelvic floor muscle weight training system, comprising:

a two-piece casing including a first piece and a second piece, the first piece having a first inside thread, and the second piece having a second inside thread;

a weight, the weight being retainable in the casing;

a retaining member being mountable on the weight, the retaining member having a third outside thread; and wherein the retaining member and the weight are removably encased within the two-piece casing by engaging the first and second inside threads with the third outside thread.

12. A pelvic floor muscle weight training system of claim 11, wherein the weight is made of one material.

13. A pelvic floor muscle weight training system of claim 12, wherein the weight is made of stainless steel.

14. A pelvic floor muscle weight training system of claim 11, wherein the second piece has a cone shape with a wider first end and a narrower second end.

15. A pelvic floor muscle weight training system of claim 11, wherein the first and second pieces are separable from each other and connectable via the retaining member.

16. A pelvic floor muscle weight training system of claim 11, wherein the weight has a cone shape.

17. A pelvic floor muscle weight training system of claim 11, wherein the weight has a cylindrical shape.

18. A pelvic floor muscle weight training system of claim 11, further comprising a retrieval loop for retrieving the casing out of user's vagina, the retrieval loop being knotted within the second piece of the casing.

19. A pelvic floor muscle weight training system of claim 18, wherein the retrieval loop is made of nylon and epoxied in place within the second piece of the casing.

20. A method of testing pelvic floor muscles utilizing a set of weights individually retained in a universal casing, the casing including a cap and a bottom, the cap having a first inside thread, and the bottom having a second inside thread, each of the weights being different in shape and weight and retainable individually in the casing, a retaining member being mountable on each of the weights, the retaining member having a third thread, wherein the retaining member and its respective weight are encased within the casing by engaging the first and second threads with the third thread, the method comprising the steps of:

a) inserting a first end of a first of the weights from the set into the bottom of the casing;

b) threading the bottom of the casing onto the retaining member;

c) inserting a second end of the first weight into the cap of the casing;

d) threading the cap onto the retaining member to form a first weight/casing; and e) inserting the first weight/casing into user's vagina to test whether the pelvic floor muscles can support the first weight/casing.

21. The method of claim 20, further comprising: f) replacing the first weight by a second weight from the set to form a second weight/casing and repeating step e), wherein steps f) and e) are repeated until a third weight/casing is just capable of being supported, the respective weight of the third weight/casing providing an indication of strength of the pelvic floor muscles.

22. A method of exercising pelvic floor muscles utilizing a set of weights individually retained in a universal casing, the casing including a cap and a bottom, the cap having a first inside thread, and the bottom having a second inside thread, each of the weights being different in shape and weight and retainable individually in the casing; a retaining member being mountable on each of the weights, the retaining member having a third thread, wherein the first and second threads of the casing are capable of threading with the third thread of the retaining member, the method comprising the steps of:

a) inserting a first end of a first of the weights from the set into the casing;

b) threading the bottom onto the retaining member;

c) inserting a second end of the first weight into the cap of the casing;

d) threading the cap onto the retaining member to form a first weight/casing; and e) inserting the first weight/casing into user's vagina to check whether the pelvic floor muscles can support the first weight/casing.

23. The method of claim 22, further comprising: f) replacing the first weight by a second weight from the set to form a second weight/casing, the second weight being heavier than the first weight; and g) the user holding the second weight/casing for a predetermined time by contracting the pelvic floor muscles.

24. The method of claim 22, further comprising: f) replacing the first weight by a second weight from the set to form a second weight/casing, the second weight being lighter than the first weight; and g) the user holding the second weight/casing for a predetermined time by contracting the pelvic floor muscles.

* * * * *

UNITED STATES PATENT AND TRADEMARK OFFICE

CERTIFICATE OF CORRECTION

PATENT NO. : 6,068,581
DATED : May 30, 2000
INVENTOR(S) : Anderson

It is certified that error appears in the above-identified patent and that said Letters Patent is hereby corrected as shown below:

Column 7,
Line 28, after "thread;" insert -- wherein substantially all of the retaining memer is disposed approximate one end of the weight --

Signed and Sealed this

Twenty-fifth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,068,581
DATED : May 30, 2000
INVENTOR(S) : Anderson

It is certified that error appears in the above-identified patent and that said Letters Patent is hereby corrected as shown below:

This certificate supersedes Certificate of Correction issued December 25, 2001, the number was erroneously mentioned and should be deleted since no Certificate of Correction was granted.

Signed and Sealed this

Eighth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,068,581
DATED : May 30, 2000
INVENTOR(S) : Anderson

It is certified that error appears in the above-identified patent and that said Letters Patent is hereby corrected as shown below:

Column 7,
Line 28, after "thread;" insert -- wherein substantially all of the retaining member is disposed approximate one end of the weight --

Signed and Sealed this

Twenty-fifth Day of February, 2003

JAMES E. ROGAN
*Director of the United States Patent and Trademark Office*